US010343362B1

(12) United States Patent
Fragstein et al.

(10) Patent No.: US 10,343,362 B1
(45) Date of Patent: Jul. 9, 2019

(54) AIR-ASSISTED RUBBER BALERS AND BALING METHODS

(71) Applicant: Karltex Machine, Inc., Orange, TX (US)

(72) Inventors: Sig Fragstein, Orange, TX (US); Donnie L. Cobb, Orange, TX (US); Carl Johnson, Orange, TX (US); Paul Sozzi, Orange, TX (US)

(73) Assignee: Karltex Machine, Inc., Orange, TX (US)

( * ) Notice: Subject to any disclaimer, the term of this patent is extended or adjusted under 35 U.S.C. 154(b) by 0 days.

(21) Appl. No.: 15/948,780

(22) Filed: Apr. 9, 2018

(51) Int. Cl.
*B30B 9/30* (2006.01)

(52) U.S. Cl.
CPC ..... *B30B 9/3035* (2013.01); *B30B 9/301* (2013.01); *B30B 9/3057* (2013.01)

(58) Field of Classification Search
CPC ..... B30B 9/301; B30B 9/3057; B30B 15/302; B30B 15/0082; B30B 9/3035
USPC ..... 100/215, 240, 245
See application file for complete search history.

(56) References Cited

U.S. PATENT DOCUMENTS 1,998,166 A 4/1935 Nelson
2,488,395 A * 11/1949 Goldberg ..... B68G 7/06 100/102
2,748,694 A 6/1956 Thompson
3,025,785 A * 3/1962 Deems ..... B30B 9/301 100/215
3,107,604 A * 10/1963 Deems ..... B30B 9/30 100/215
3,139,676 A 7/1964 Grover
3,176,808 A 4/1965 Matthews
3,377,553 A 4/1968 Lillard
3,554,060 A 1/1971 Gargrave et al.
3,583,312 A * 6/1971 Van Doorn ..... B30B 9/301 100/215

(Continued)

FOREIGN PATENT DOCUMENTS

CN 202923005 U 5/2013
CN 203485469 U 3/2014

OTHER PUBLICATIONS

Notification of Transmittal of the International Search Report and Written Opinion dated Apr. 25, 2017, issued in International Application No. PCT/US2016/069471 (17 pages).

*Primary Examiner* — Jimmy T Nguyen
(74) *Attorney, Agent, or Firm* — Beem Patent Law Firm

(57) ABSTRACT

Improved bales may be formed using methods that include using baling equipment with an air blasting crumb chute that may reduce wear and tear and maintenance, and/or improve efficiency by reducing material waste, imperfections, and/or contamination. The crumb chute may include an air inlet and a plurality of apertures in fluid communication with the air inlet. Air may be provided through the apertures to prevent crumbles from accumulating on the baling assembly as they fall through the chute to the press chamber and/or to blast already accumulated residual crumbles from components of the baling assembly, such as a traveling chute, and into the press chamber. The crumb chute may include a polyoxymethylene insert in which the air inlet and apertures are provided. The crumb chute may be provided as a kit for attachment to various baling apparatuses. Additional features and components also are described.

18 Claims, 11 Drawing Sheets

(56) References Cited

U.S. PATENT DOCUMENTS

| | | | | | |
|---|---|---|---|---|---|
| 3,655,851 | A | | 4/1972 | Shelton et al. | |
| 3,765,324 | A | * | 10/1973 | O'Neill | B30B 9/301 100/215 |
| 3,895,572 | A | * | 7/1975 | Nitschke | B30B 9/30 100/215 |
| 4,024,807 | A | | 5/1977 | Karsen | |
| 4,127,062 | A | | 11/1978 | Egosi | |
| 4,206,699 | A | | 6/1980 | Hemmelgarn | |
| 4,273,037 | A | * | 6/1981 | Ruebesam | B30B 9/3003 100/229 A |
| 4,287,823 | A | | 9/1981 | Thompson | |
| 4,826,416 | A | | 5/1989 | Majerus | |
| 5,694,742 | A | * | 12/1997 | Elliott | B30B 9/301 100/218 |
| 5,768,932 | A | | 6/1998 | Hahn | |
| 5,870,951 | A | | 2/1999 | Fragstein | |
| 6,074,738 | A | | 6/2000 | von Fragstein | |
| 6,170,392 | B1 | | 1/2001 | Watercutter | |
| 6,256,969 | B1 | | 7/2001 | Fragstein | |
| 6,261,678 | B1 | | 7/2001 | von Fragstein | |
| 6,293,759 | B1 | | 9/2001 | Thut | |
| 6,352,023 | B1 | * | 3/2002 | Dunaway | B30B 9/301 100/215 |
| 6,776,361 | B1 | * | 8/2004 | Watanabe | B05B 7/1404 222/195 |
| 7,762,265 | B2 | * | 7/2010 | Hicks | A24B 1/10 100/215 |
| 9,878,511 | B2 | * | 1/2018 | Fragstein | B30B 9/3021 |
| 2017/0219003 | A1 | * | 8/2017 | Hwang | F16B 39/284 |

* cited by examiner 530
536
535
533
222

530
536
535
222
532

530
536
535
222
532

530
536
535
222
532

530
536
535
222
532

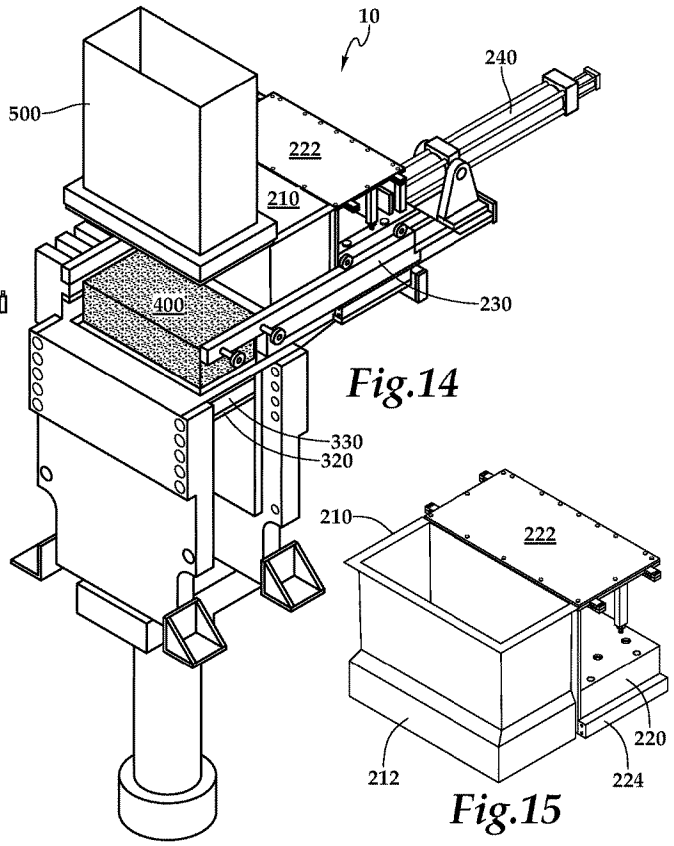
Fig.14
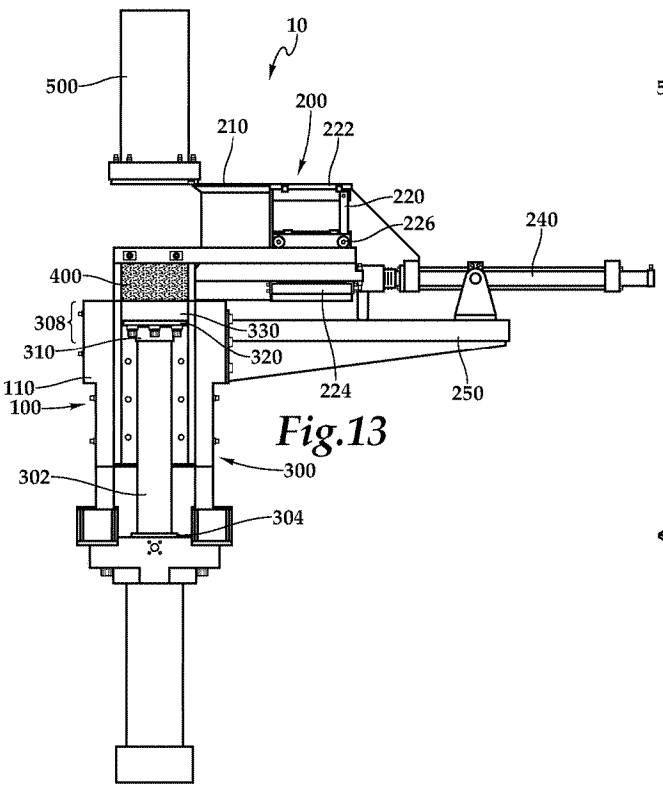
Fig.13
Fig.15

AIR-ASSISTED RUBBER BALERS AND BALING METHODS

RELATED APPLICATIONS

The present application is related to U.S. Pat. No. 9,878,511 issued Jan. 30, 2018 and U.S. patent application Ser. No. 15/847,311 filed Dec. 29, 2017, both of which are incorporated by reference in their entirety.

BACKGROUND OF THE INVENTION

1. Technical Field

The present invention relates to rubber bales and baling equipment, and more particularly to equipment that uses air blasting to reduce maintenance and/or improve efficiency by reducing material waste and/or contamination.

2. Related Art

Rubber baling is, ideally, a twenty-four hours a day, seven days a week endless process. In reality, rubber is a notoriously difficult material to handle and its complexities and characteristics dictate that baling machines must be periodically maintained. For example, rubber must be handled with care, taking into consideration its various intended uses, some of which are for food or pharmaceutical grade rubber. Especially for the latter purpose, contamination must be avoided. A change of product may require complete cleaning of equipment, sometimes requiring disassembly, particularly of balers.

Color, which may be white or transparent, must be considered. Irregularities such as "teats" remaining on the outer surfaces of bales after forming at high pressure—the teats corresponding to small holes or crevices in the baling machine—are undesirable but inevitable as artifacts of the baling process. Sometimes teats break off in the machine and remain lodged there for several cycles, transforming in color from white to gray, and then sometimes coming loose and being molded into a bale which is then ejected with a discolored teat, which can result in rejection of the bale, especially in pharmaceutical grades and the like. Maintenance is demanding. Heavy pieces of equipment must be maneuvered in tight, crowded spaces. Each second of downtime is lost profit.

After synthetic rubber is dried in large sheets, it is crumbled and baled. The pieces are larger—some of them becoming fused together—or smaller with a great deal of dust—all of which is desired to be formed into bales. The crumbles may vary in size depending on their Mooney rating. For example, dry, low Mooney crumbles may be between about the size of talcum powder or dust to about the size of a walnut, while wet, sticky, high Mooney crumbles may be between about the size of a walnut to about the size of an orange.

During a typical baling process, crumbles are deposited into a drop chamber where they are weighed atop a set of trap doors. Once the appropriate amount of crumbles are present, the doors open and the crumbles travel the remaining portion of the drop chute, through a travelling chute that sits atop the press chamber. The travelling chute then moves to position panels that close the press chamber below and the drop chute above. While the crumbles are compressed in the press chamber by a hydraulic ram to form a bale, the next batch of crumbles is deposited and weighed atop the trap doors above. Once the bale is formed, the traveling chute moves again so the bale can be ejected from the press chamber and sent off for further processing. The process then repeats.

At various points during this process, the mess of dust can fall back in, contaminating the next batch in the run and forming irregularities and causing material waste. For example, as crumbles travel through the drop chute on their way to the press chamber, material may be expelled out of the clearance between the assembly components (such as the drop chute and the travelling chute). As another example, crumbles may leak through the trap doors during the weighing process, landing on the travelling chute panel below. All of these leakages literally gum up the machinery, increasing service time, decreasing profits.

Accordingly, a need has long existed for even further improved systems and methods for rubber baling.

SUMMARY

Improved bales may be formed using methods that include using baling equipment with an air blasting crumb chute that may reduce wear and tear and maintenance, and/or improve efficiency by reducing material waste, imperfections, and/or contamination. The crumb chute may include an air inlet and a plurality of apertures in fluid communication with the air inlet. Air may be provided through the apertures to prevent crumbles from accumulating on the baling assembly as they fall through the chute to the press chamber and/or to blast already accumulated residual crumbles from components of the baling assembly, such as a traveling chute, and into the press chamber. The crumb chute may include a polyoxymethylene insert in which the air inlet and apertures are provided. The crumb chute may be provided as a kit for attachment to various baling apparatuses.

Other systems, methods, features and technical advantages of the invention will be, or will become apparent to one with skill in the art, upon examination of the figures and detailed description. It is intended that all such additional systems, methods, features and technical advantages be included within this summary and be protected by the claims.

BRIEF DESCRIPTION OF THE DRAWINGS

The invention can be better understood with reference to the following drawings and description. The components in the figures are not necessarily to scale, emphasis instead being placed upon illustrating the principles of the invention.

FIGS. 9-10 show perspective views of exemplary rubber bales formed using the exemplary air-assisted baler press assembly of FIG. 1;

FIGS. 11-14 show side and perspective views of the exemplary baler press assembly of FIG. 1 at various stages of a bale forming process; and FIG. 15 shows a perspective view of an exemplary traveling crumb box and cover assembly for use in the exemplary air-assisted baler press assembly of FIG. 1.

DETAILED DESCRIPTION OF THE PREFERRED EMBODIMENTS

The elements illustrated in the figures interoperate as explained in more detail below. Before setting forth the detailed explanation, however, it is noted that all of the discussion below, regardless of the particular implementation being described, is exemplary in nature, rather than limiting.

1.0 Baler Assembly Overview

Figure 1:
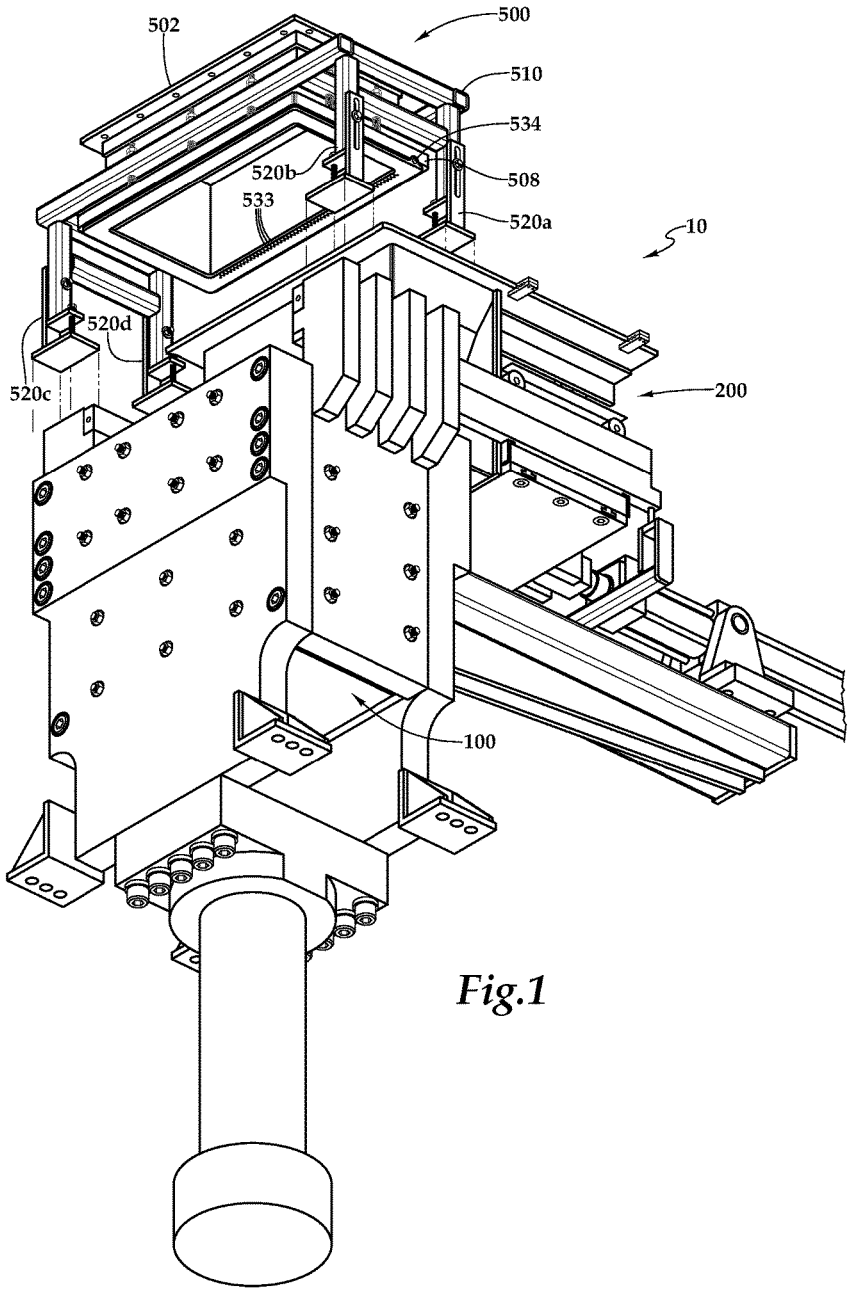
FIG. 1 shows a perspective view of an exemplary air-assisted baler press assembly.
Figure 2:
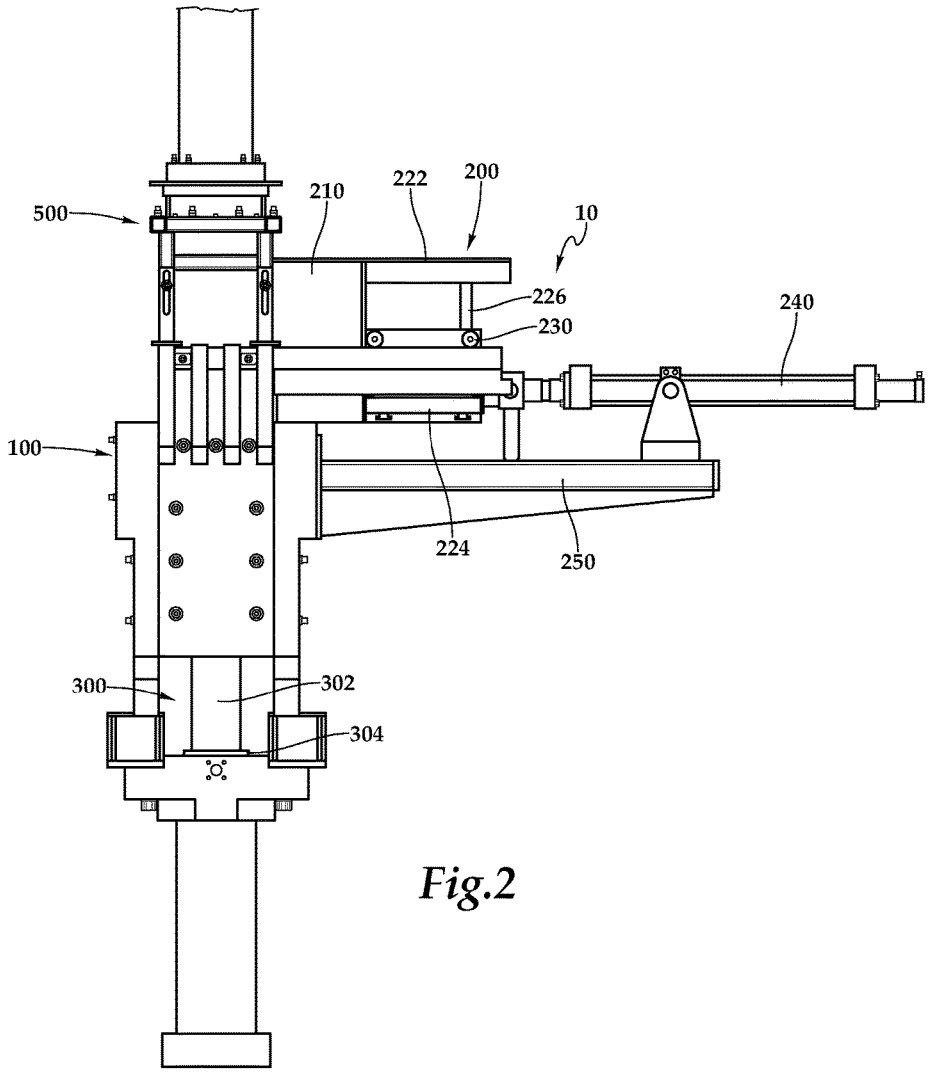
FIG. 2 shows a side cross-sectional view an exemplary baler press assembly with an exemplary air blasting crumb chute for use in a baler press assembly.

Referring to the drawings, and initially to FIGS. 1 and 2, a perspective view and a side view of an exemplary upstroke baler press assembly 10 are shown. Only relevant portions of the baler press assembly 10 are shown; other portions are well known to those skilled in the art and are not discussed herein for sake of clarity. In the illustrated embodiment, the baler press assembly 10 may include a press chamber 100, a bale ejector assembly 200 and a ram assembly 300. The press chamber 100 may include press walls 110 that function to provide a rigid support capable of withstanding at least the compression forces necessary to form the bale (described below). Press wall liners 120 may be secured to the inside of the press walls 110, such as by means of socket cap screws. Other types of securing mechanisms also may be used in place of the socket cap screws.

The ram assembly 300 may include a hydraulic rod 302 positioned within a rod housing and scraper 304. A bolster assembly 308 may be secured to the end of the hydraulic rod 302. Hydraulic power from the power unit may be supplied to the baler press assembly 10 at a number of power connection points.

2.0 Exemplary Adjustable Crumb Chutes 500

Figure 3:
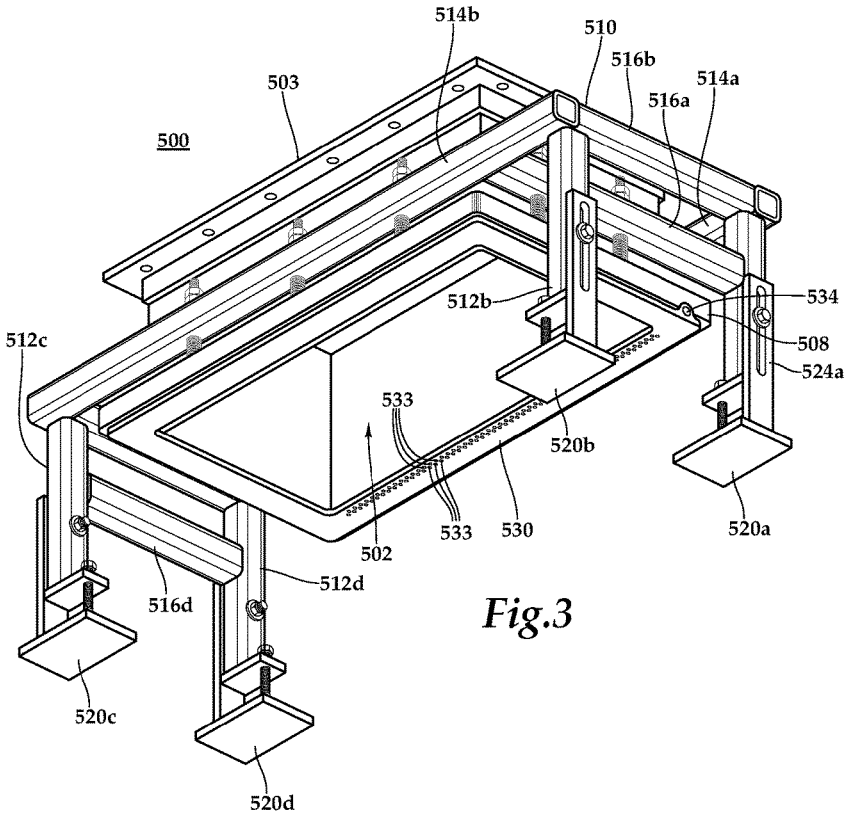
FIG. 3 shows a perspective view of the exemplary air blasting crumb chute.
Figure 4:
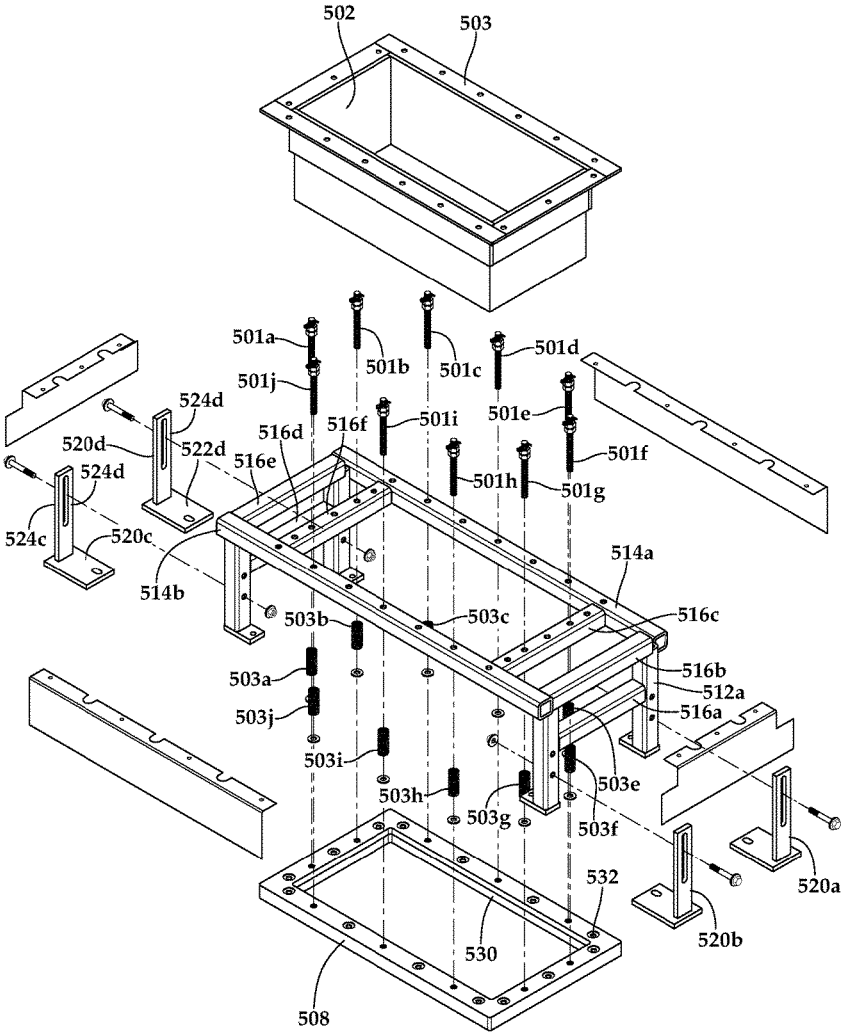
FIG. 4 shows an exploded view of the exemplary air-blasting crumb chute of FIG. 3.
Figure 5A:
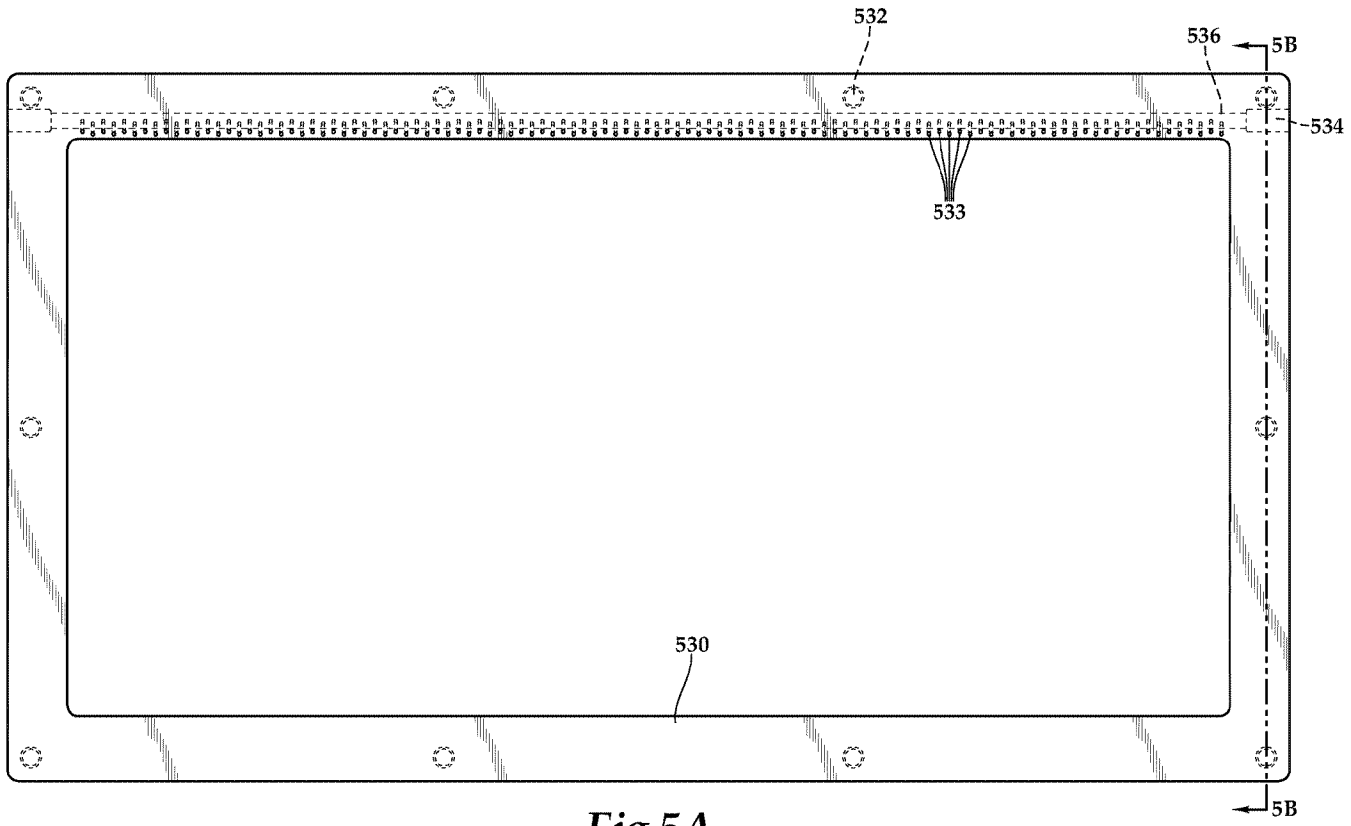
FIGS. 5A-D show various views of an exemplary ring insert for use in the exemplary air blasting crumb chute of FIG. 2.
Figure 5B:
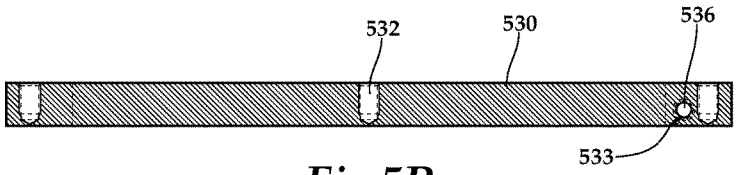
Figure 5C:
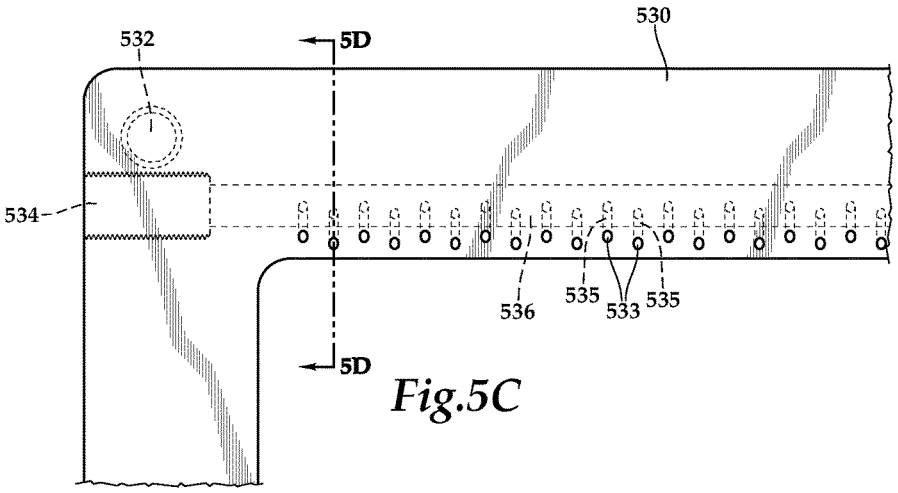
Figure 5D:
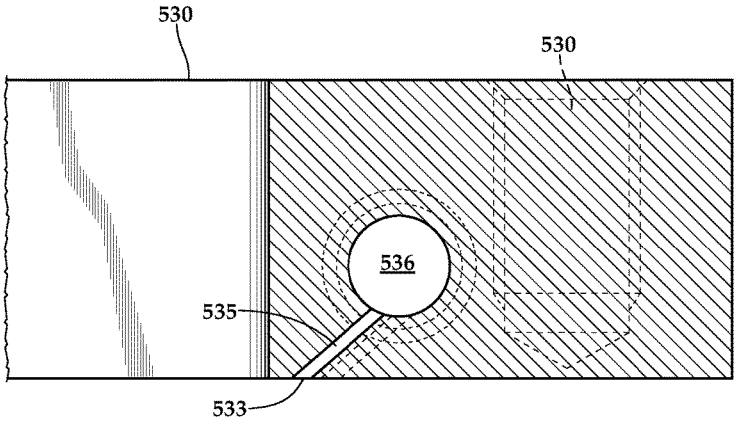
Figures 6A, 6B, 6C, 6D, 6E:
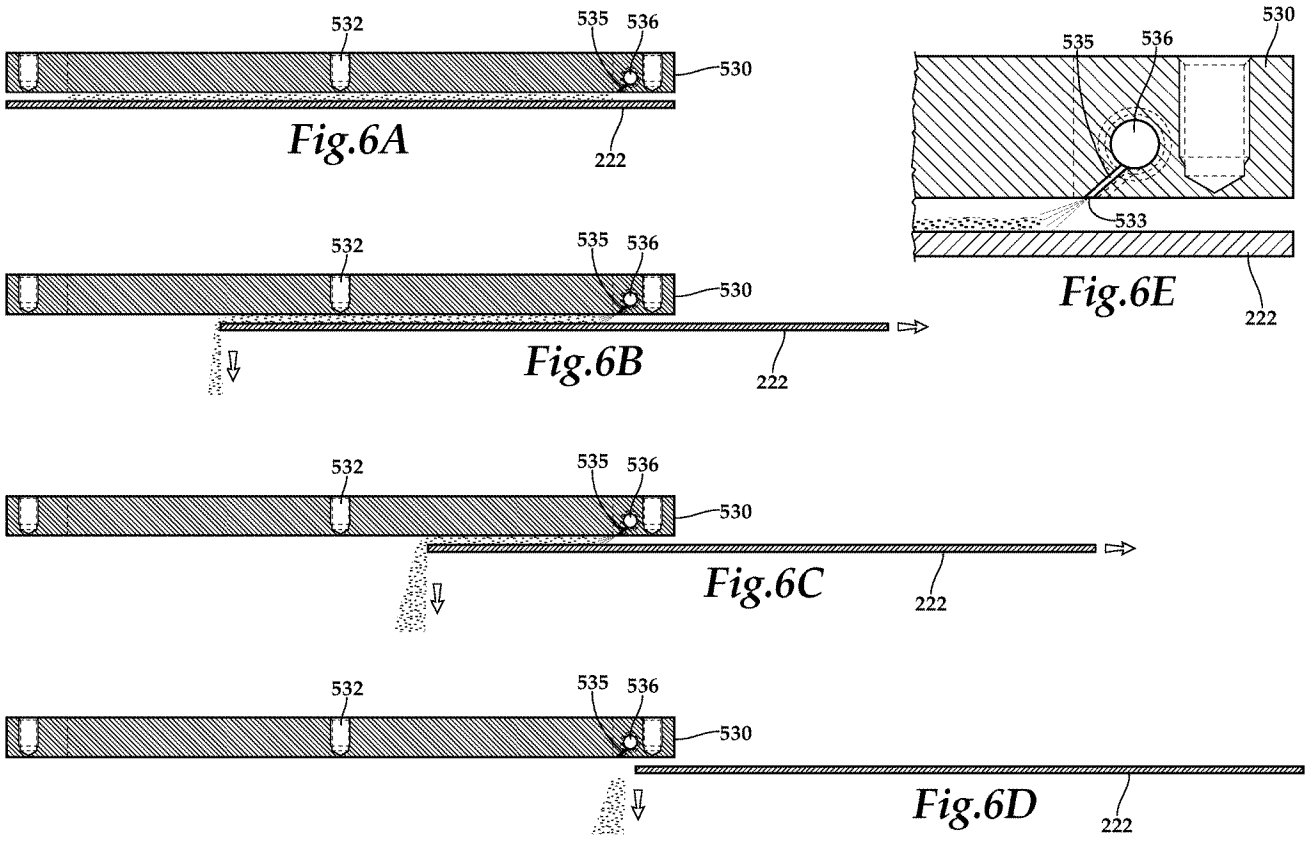
FIGS. 6A-D show various views of an exemplary air-blasting portion of the exemplary air blasting crumb chute of FIG. 2 in various positions as crumbs are blasted off an exemplar top plate of an exemplary travelling chute.
FIG. 6E shows an enlarged view of a portion of the view shown in FIG. 6A.

Referring to FIGS. 3-4, an exemplary air blasting crumb chute 500 is shown in perspective and exploded views. The air blasting crumb chute 500 may include a chute body 502 coupled to a frame 510. In operation, the air blasting crumb chute 500 may provide a pathway for directing crumbles into the press chamber 100 of the baling assembly 10 and also may include a plurality of apertures 533 in fluid communication with an air inlet 534 coupled to an air source to provide an air blast that reduces the accumulation of and/or removes residual crumbles from the chute body 502 and other portions of the chute 500 and/or baling assembly 10 and into the press chamber 10. As a result, the chute 500 may increase the overall efficiency of the baling process and reduce maintenance requirements stemming from crumb build-up on the machinery.

The crumb chute 500 may include a chute body 502 coupled to a frame 510 by a plurality of bolts 501*a-j* and springs 503*a-j*. The springs 503*a-j* may be any suitable springs and preferably are stainless steel springs that provide between about 15 ft/lbs and about 20 ft/lbs of tension. In some embodiments, the springs 503*a-j* may be Precision Compression Spring 316SS provided by Gardner having a spring/tension rating of 25.536 lb and a spring spec of 0.845 OD×0.091×wire size×3" long. In operation, the springs 503*a-j* may act as shock absorbers as various forces are applied to the chute body 502, such as by the falling crumbles being added to the press chamber 100 or by the travelling crumb box 210 making contact with the chute body 502 as it is positioned under the chute body 502 or travelling under the chute box 502 to eject a newly formed bale. The springs 503*a-j* also may allow the chute body 502 to vary in height to enable attachment to various sized baling assemblies 10.

The adjustability provided by the springs 503*a-n* may allow the clearance between the adjustable crumb chute 500 and the travelling chute 210 to be smaller than existing clearances. For example, the clearance between the traveling chute 210 and the adjustable crumb chute 500 about 1/1000 inch and about 20/1000 inch, preferably between about 3/1000 and about 1/100 inch, and even more preferably between about 5/1000 inch and about 7/1000 inch. Other clearances also may be used.

2.1 Exemplary Chute Bodies 502

The chute body 502 may include an upper flange 504, a chute channel 506, a lower flange 508 and a ring insert 530. The upper flange 504 may be coupled to a larger chute from which crumbles are directed into the baling assembly 10, such as by bolts, welding or the like. The chute channel 506 may define a pathway between the larger chute and the travelling crumb box 210 through which crumbles may pass as they are inserted into the press chamber 100. The lower flange 508 may define a cavity for receiving the ring insert 530. In some embodiments, the lower flange 508 and ring insert 530 may be combined in a unitary structure, or the lower flange 508 may include the features of the ring insert 530.

Referring also to FIGS. 5A-D, an exemplary ring insert 530 is shown. In the illustrated embodiment, the ring insert 530 may include a body 531, a plurality of cavities 532, a plurality of apertures 533, one or more inlets 534, and a channel 536. The body 531 may be made of any suitable material, such as plastic, metal or the like, and preferably is made of a thermoplastic polymer, such as polyoxymethylene or the like. As used herein, the term "thermoplastic polymer" is defined to encompass the DuPont materials Delrin® and Delrin AF® and any other materials having similar relevant properties. Delrin® is an acetal resin thermoplastic polymer (or acetal homopolymer) manufactured by the polymerization of formaldehyde. Delrin AF® contains high tensile strength fibers of Teflon® fluoroplastic resin. Similar wear resistant materials having low static and dynamic coefficients of friction (as compared to steel) and capable of being formed into or bonded to press wall liners and bolster caps are considered to fall within the scope of the term thermoplastic polymer as used in the claimed invention. Cavities 532 may be threaded and may receive bolts for coupling the ring insert 530 to the lower flange 508. The lower flange 508 may include through holes that allow it to be coupled to the frame 514*a-d* using bolts 501*a-j* and springs 503*a-j* as well as washers mounted to the threaded cavities 532.

The inlets 534 may be in fluid communication with a plurality of apertures 533 via a channel 536 and a plurality of sub-channels 535. In the illustrated embodiment, the insert 530 includes two inlets 534. Alternatively, or additionally, more or less inlets 534 may be provided. The inlets 534 may be coupled to an air source 540, such as an industrial air supply line (sometimes referred to as plant air), which typically includes a valve that allows for adjustment of air pressure provided at the line. Alternatively, or additionally, the air source 540 may be a stand-alone air supply, such as a compressor that is provided on the frame 510, the chute body 502, a part of the baling assembly 10, or elsewhere. In the illustrated embodiment, the inlets 534 include a ¼ inch 18 thread density National Pipe Thread (NPT) threading for attached to air source 540 and the channel 536 is a circular channel having a diameter of about ⅓ inch.

The apertures 533 may be disposed near the inner radius of the ring insert 530, such as, for example, within about ½ inch of the inner radius, preferably within about ⅓ inch of the inner radius and even more preferably within about ¼ inch of the inner radius. The apertures 533 may be provided in a single row, or multiple rows. For example, two or more rows of apertures 533 may be provided to accommodate variations in travelling crumb box 210 sizes and positioning, which may cover certain apertures 533 during the baling process.

Each aperture 533 may be connected to the primary channel 536 by a corresponding sub-channel 535. The sub-channels 535 may be angled so that the air exits the apertures 533 at a desired angle. For example, a sub-channel 535 may be angled so that air exits its corresponding aperture 533 at an angle between 10 and 70, preferably between at an angle between about 25 and about 55 and even more preferably between about 35 and about 45. In the illustrated embodiment, the sub-channel 535 is angled so that air exits the aperture 533 at about 40 degrees. Other angles also may be used. Preferably, the apertures 533 and sub-channels 535 are positioned so that the air flows down (toward the press chamber) and inward (toward the center of the chute body 510). Other directions also may be used.

In the illustrated embodiment, the apertures 533 are provided on one side of the ring insert 530. Alternatively, or additionally, apertures 533 may be provided on multiple sides of the insert 530. In such embodiments, the ring insert 530 may include additional inlets 534 and channels 536, or the channel 536 may be extended to reach the additional sides. Air may be blasted through sets of apertures simultaneously, sequentially, or any combination thereof.

The apertures 533 may be circular, square or any other suitable shape. In some embodiments, the apertures 533 may be circular and have a diameter between about 1/16 inch and about ¼ inch, preferably between about 1/12 inch and about 3/16 inch. Other sizes also may be used. In the illustrated embodiment, the apertures 533 are ⅛ inch circular apertures spaced about ¼ inch from one another in two rows displaced by about 1/16 inch from one another.

Figure 7:
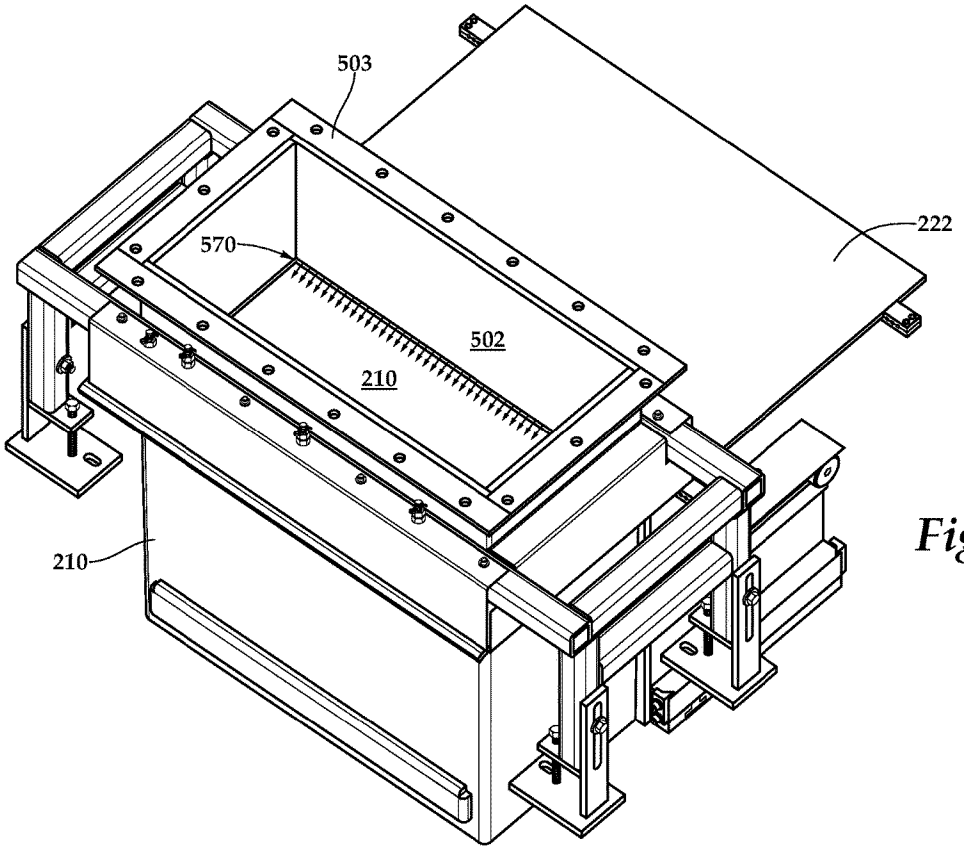
FIG. 7 shows a perspective view of an exemplary travelling crumb box and cover assembly for use in the exemplary baler press assembly of FIG. 1.
Figure 8:
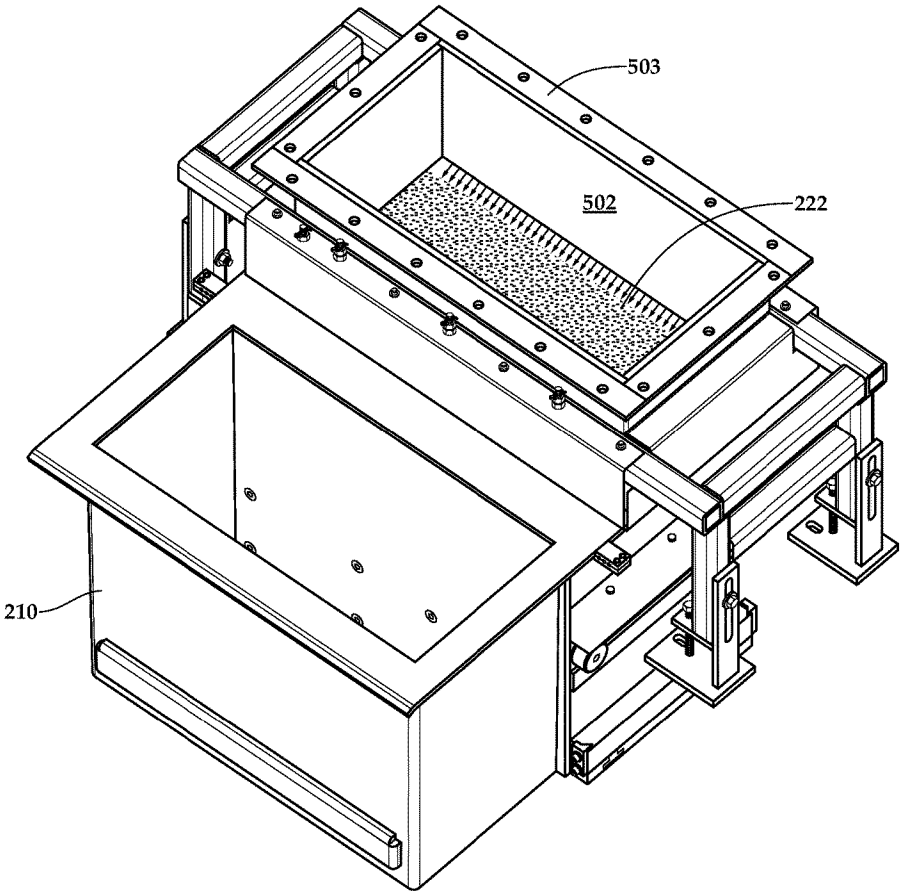
FIG. 8 shows another perspective view of an exemplary air blasting crumb chute and exemplary travelling chute at another stage of a baling process.

Air may be blasted through the apertures 533 at various points in the baling process. As one example (shown in FIG. 7), air may be blasted through apertures 533 when the traveling chute 210 is positioned below the adjustable crumb chute 500 as a weighed batch of crumbles are deposited into the press chamber 100. By providing air at this point in the baling process, the air may act as a barrier or "wall of air" that prevents crumbles from falling between any gaps between the travelling chute 210 and the adjustable chute 500.

As another example (shown in FIGS. 8 and 6A-D), air may be blasted to clear loose crumbles off the top plate 222 as the travelling chute 210 moves through various positions in the baling process. For example, after a formed bale is ejected from the press chamber 100 and pushed onto a conveyor belt for further processing (as described below in Section 4.0), loose crumbles may accumulate atop top plate 222 as shown in FIGS. 8 and 6A-D. As the top plate 222 moves back into position so that the travelling chute 210 is positioned directly underneath adjustable chute 500 to deposit the next batch of crumbles in the press chamber 100 (the position shown in FIG. 8), air may be blasted to "sweep" the crumbles off the top plate 222 and into the press chamber 100 through the traveling chute 210 as shown in FIGS. 6A-D. Air also may be blasted through apertures 533 at other times.

In addition, as noted above, the adjustable crumb chute 500 may be provided with small clearances to the traveling chute 210. Because these clearances are so small, the body 502 of the chute 500 also may act to "sweep" the top plate 222 of the traveling chute 210 of residual crumbs that may accumulate during the baling process if crumbs either accumulate higher than the clearance or if larger crumbs are introduced to the process.

Air may be blasted through the apertures 533 at various pressures and durations depending on the type of materials being compressed. For example, low moony crumbles may be blasted with pressures between about 5 PSI and about 30 PSI, preferably between about 8 PSI an about 20 PSI, and even more preferably between about 10 PSI and about 15 PSI. For high moony crumbles, air may be blasted at between about 2 PSI and about 10 PSI, preferably between about 3 PSI and about 7 PSI, and even more preferably about 5 PSI. Other pressures may be used.

Air may blasted for a duration appropriate for the current stage in the baling process and/or the particular material being compressed. For example, to form a barrier when crumbles are being deposited in the press chamber 100 air may be blasted for between about 0.5 second and about 10 seconds, preferably between about 0.75 second and about 5 second, and even more preferably between about 1 second and about 3 seconds and in some embodiments air may be provided for about 2 seconds. As another example, when crumbles are being swept off the top plate 222, air may be blasted for substantially all of the time that the plate 222 is in motion. In some embodiments, air may be provided continuously throughout some or all stages of a baling process. Other pressures and/or durations also may be used.

2.2 Exemplary Frames 510

The frame 510 may include a plurality of legs 512*a-d* coupled to one another by longitudinal frame members 514*a-b* and lateral frame members 516*a-f*. In some embodiments, the legs 512*a-d* may be about 11½"×2"×2", the longitudinal members 514*a-b* may be about 13⅞"×2"×2" and the lateral members 516*a-f* may be between about 40" to 45⅝"×2"×2" and the adjustment members 520*a-d* may be about 4"×6"×½". Other sizes also may be used.

The legs 512*a-d* may be disposed atop adjustment members 520*a-d* that are in turn coupled to the bale press assembly 10 so that the crumb chute 500 is positioned directly above the press chamber 100. The adjustment members 520*a-d* each may include a base 522 that may be coupled to the bale press assembly 10, a vertical member 524 that may be coupled to a corresponding leg 512*a-d* and an adjustable platform 526 upon which the corresponding leg 512*a-d* may stand. The adjustment members 526 may be adjustable, for example, by turning a threaded bolt 528 that abuts the base 522 and is disposed in a threaded aperture 527 in the platform 526.

Preferably, the platforms 522 are positioned so that the lower edge of the chute body 502 rests between about ⅜ inch and about ¾ inch above the top of the travelling crumb box 210 when it is positioned under the chute body 500, preferably between about 7/16 inch and about 11/16 inch above the top of the travelling crumb box 210 when it is positioned under the chute body 500, even more preferably between about ½ inch and about ⅝ inch above the top of the travelling crumb box 210 when it is positioned under the chute body 500, and in one embodiment about 9/16 inches above the top of the travelling crumb box 210 when it is positioned under the chute body 500. Other heights also may be used.

3.0 Exemplary Bolster Assemblies and Ejector Mechanisms

The air-assisted baler assembly 10 may employ a variety of bolster assemblies 308 and ejector mechanisms 200 to form bales in the air-assisted baling assembly 10. For example, the bolster assemblies 308 and ejector mechanisms 200 described in U.S. Pat. No. 9,878,511 issued Jan. 30, 2018 and U.S. patent application Ser. No. 15/847,311 filed Dec. 29, 2017, both of which are incorporated by reference in their entirety, may be used. Alternatively or additionally, other bolster assemblies 308 and ejector mechanisms 200 also may be used.

4.0 Bale Forming Methods

Figures 9, 10, 11, 12:
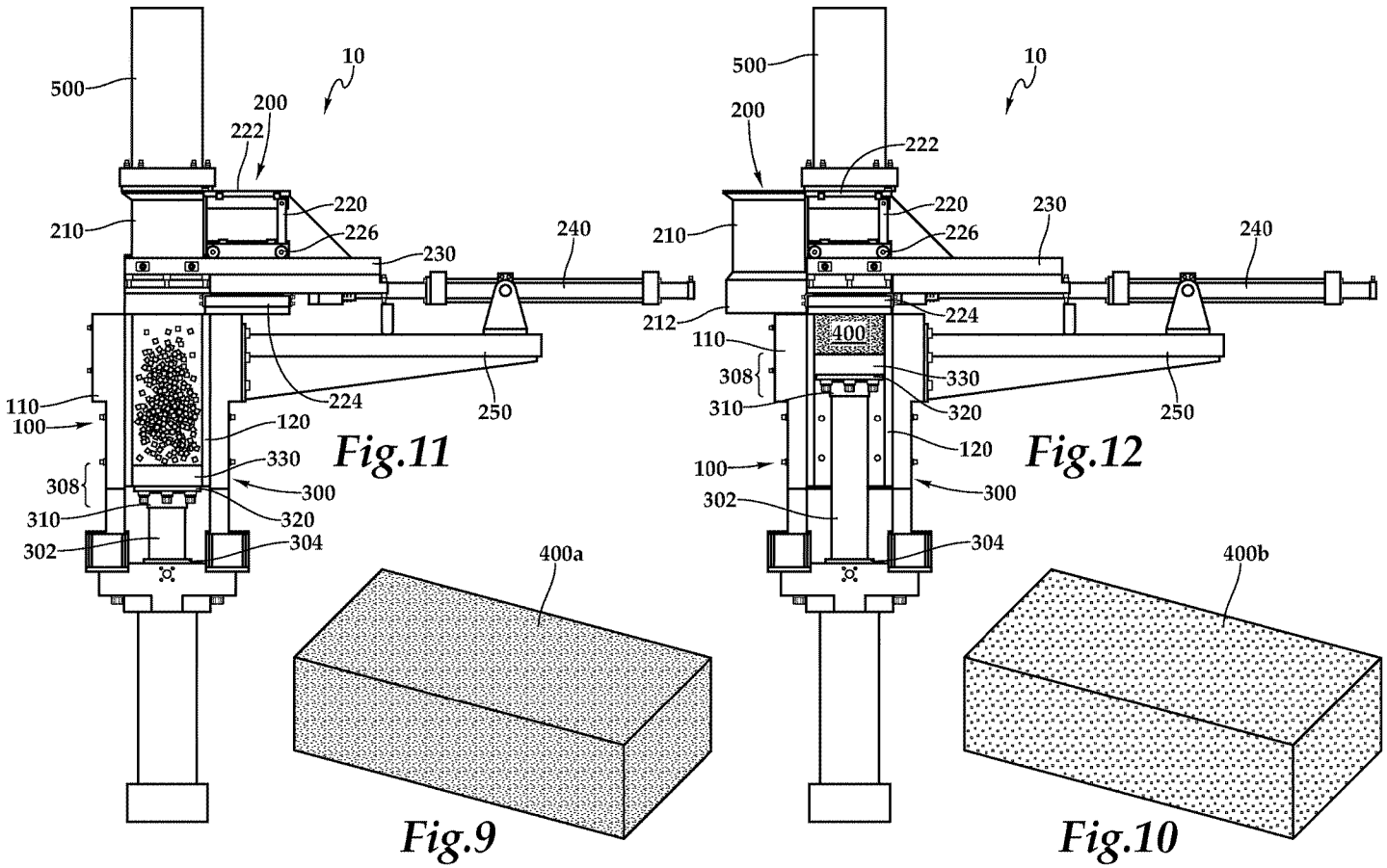

Referring to FIGS. 1-2 and 11-14, during normal operation, rubber crumbles or other compressible materials may be weighed and supplied to the press chamber 100 via a conveyor belt (not shown). As shown in FIG. 11, the travelling crumb box 210 may be positioned between the adjustable crumb chute 500 and the press chamber 100 at this time to provide a pathway for crumbles to enter the press chamber 100 to ensure that the full weighed amount of crumbles enters the press chamber 100. Air may be blasted through apertures 533 during this stage of the process to form a barrier between the adjustable chute 500 and the travelling crumb box 210 to prevent crumbles from spraying onto other components of the baler assembly 10.

Next, the cover assembly 220 is positioned between the press chamber 100 and the crumble chute 500, as shown in FIG. 12. The top plate 222 may close off the crumble chute 500 at this time to prevent additional rubber crumbles or other compressible materials from spraying onto the baler assembly 10. The cover plate 224 may close off the top of the press chamber, which prevents rubber crumbles or other compressible materials from exiting the press chamber. In some embodiments, the cover plate 224 is positioned so as to allow a small gap between the cover plate 224 and the top of the press chamber 100. This gap may allow air to escape from the press chamber 100 during a bale forming operation and prevent the vapor lock and/or the formation of a "fluffy" bale. Preferably, the cover plate 224 is positioned to provide a gap between about 1/100 inches and about 15/1000 inches.

Next, the ram assembly 300 may be activated. Upon activation, hydraulic power may be applied to the ram assembly 300 such that the hydraulic rod 302 travels in an upward direction, forcing the bolster assembly 308 into the press chamber 100. The baler press assembly 10 may be powered by a hydraulic power unit (not shown). The compression force applied by the ram assembly 300 may be of sufficient magnitude to form a solid bale of the compressible material contained in the press chamber 100. For example, the compression force may be between about 1000 pounds per square inch (PSI) and about 1500 PSI and preferably about 1200 PSI for low Mooney crumbles. For high Mooney crumbles, the compression force may be between about 1500 PSI and about 3500 PSI, preferably between about 2000 PSI and about 3000 PSI. The dwell time, or duration of the compression period, may be between about 0.5 seconds and about 3 seconds for low Mooney crumbles, and in some embodiments about 1 second. For high Mooney crumbles, the dwell time may be between about 10 seconds and about 20 seconds, and in some embodiments about 15 seconds. Finally, the temperature of the press chamber may between about 120° F. and about 180° F., preferably between about 130° F. and about 155° F., depending on the type of material.

Following formation of the bale, the ejector mechanism may be repositioned to allow the formed bale 400 to be vertically ejected from the press chamber 100, as shown in FIGS. 13 and 14. Once the bale 400 is vertically ejected from the bale, the travelling crumb box 210 may be moved horizontally so that the bumper 212 horizontally ejects the bale 400 from the assembly 10. Next, as the travelling crumb box 210 is moved back into position between the chute 500 and the press chamber 100, air may be blasted through apertures 533 to sweep any stray crumbles that may have accumulated atop plate 222. These swept crumbles may fall through the traveling chute 210 as it reaches the desired position, and the entire process may be repeated to form additional bales.

5.0 Exemplary Bales

Exemplary bales are shown FIGS. 9-10, which show a low Mooney bale 400*a* and high Mooney bale 400*b*, respectively. As a result of performing the above described method and using the improved baling apparatuses and bolster assemblies 308 described herein, bales 400 of rubber (or other material) substantially free of imperfections and/or irregularities may be manufactured.

6.0 Exemplary Embodiment

In one embodiment, a baling apparatus for compressing rubber materials may be provided. The baling apparatus may include a hydraulic rod and a press chamber for receiving the compressible material. The baling apparatus also may include a crumb chute for directing the compressible material into the press chamber. The crumb chute may include a frame and a chute body coupled to the frame. The chute body may include an air inlet that is in fluid communication with a plurality of apertures.

It is contemplated that the novel portions of the baler press assembly 10 could be used in any type of press assembly having a press chamber. Further, the scope of the invention is not considered limited to rubber balers, but instead could be used in the compression of a wide variety of materials.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A baling apparatus for compressing a compressible material, comprising:

a hydraulic rod;

a press chamber for receiving the compressible material;

a ram assembly for compressing the compressible material in the press chamber;

a travelling chute having a crumb box, a top plate, the crumb box for directing the compressible material into the press chamber, the travelling chute movable between a first position in which the crumb box is located directly above the press chamber and a second position; and a crumb chute for directing the compressible material into the press chamber, the crumb chute positioned directly above the press chamber and including:

a frame;

a chute body coupled to the frame, the chute body including an air inlet and a plurality of apertures, the air inlet being in fluid communication with the plurality of apertures, wherein the top plate closes off the chute body when the traveling chute is in the second position, and wherein air from the plurality of apertures is configured to sweep loose crumbles of the compressible material off the top plate.

2. The baling apparatus of claim 1, where the chute body further includes a lower flange and an insert, where the lower flange houses the insert and where the insert includes the air inlet and the plurality of apertures.

3. The baling apparatus of claim 2, where the insert is made of polyoxymethylene.

4. The baling apparatus of claim 3, where the apertures are circular and have a diameter between about 1/16 inch and about 1/4 inch.

5. The baling apparatus of claim 4, where the insert further includes a channel that couples the air inlet to the plurality of apertures.

6. The baling apparatus of claim 1, where the chute body is movably coupled to the frame by a plurality of bolts and springs.

7. The baling apparatus of claim 1, where the apertures are circular and have a diameter between about 1/16 inch and about 1/4 inch.

8. The baling apparatus of claim 1, further comprising an air source coupled to the air inlet.

9. The baling apparatus of claim 1, further comprising an adjustment member that raises or lowers the frame with respect to the press chamber.

10. A crumb chute configured to direct a compressible material into a press chamber of a baling apparatus for compressing the compressible material, the baling apparatus including a traveling chute having a top plate, the travelling chute movable between a first position in which a crumb box of the travelling chute is positioned directly above the press chamber and a second position in which a cover plate of the travelling chute closes off the press chamber, the crumb chute comprising:

a frame including a plurality of legs; and a chute body coupled to the frame, the chute body positioned directly above the press chamber and including an air inlet and a plurality of apertures, the air inlet being in fluid communication with the plurality of apertures, wherein the legs are positioned so that a lower edge of the chute body is higher than an upper edge of the travelling chute, and wherein air from the plurality of apertures is configured to sweep loose crumbles of the compressible material off the top plate.

11. The crumb chute of claim 10, where the chute body further includes a lower flange and an insert, where the lower flange houses the insert and where the insert includes the air inlet and the plurality of apertures.

12. The crumb chute of claim 11, where the insert is made of polyoxymethylene.

13. The crumb chute of claim 12, where the apertures are circular and have a diameter between about 1/16 inch and about 1/4 inch.

14. The crumb chute of claim 13, where the insert further includes a channel that couples the air inlet to the plurality of apertures.

15. The crumb chute of claim 10, where the chute body is movably coupled to the frame by a plurality of bolts and springs.

16. The crumb chute of claim 10, where the apertures are circular and have a diameter between about 1/16 inch and about 1/4 inch.

17. The crumb chute of claim 10, further comprising an air source coupled to the air inlet.

18. The crumb chute of claim 10, further comprising an adjustment member that raises or lowers the frame with respect to the press chamber.

* * * * *